US008342798B2

(12) United States Patent
Floyd, II et al.

(10) Patent No.: US 8,342,798 B2
(45) Date of Patent: Jan. 1, 2013

(54) SYSTEM AND METHOD FOR CLEARANCE CONTROL IN A ROTARY MACHINE

(75) Inventors: Donald E. Floyd, II, Greenville, SC (US); Henry G. Ballard, Jr., Easley, SC (US); Brad Miller, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 12/511,005

(22) Filed: Jul. 28, 2009

(65) Prior Publication Data

US 2011/0027068 A1 Feb. 3, 2011

(51) Int. Cl.
*F01D 5/08* (2006.01)

(52) U.S. Cl. ..... 415/116; 415/115; 415/138; 415/173.2; 415/175; 415/176

(58) Field of Classification Search ..... 415/115, 415/116, 136, 138, 173.1, 173.2, 175, 176
See application file for complete search history.

(56) References Cited

U.S. PATENT DOCUMENTS

| | | | | |
|---|---|---|---|---|
| 5,035,573 | A | 7/1991 | Tseng et al. | |
| 5,056,988 | A | 10/1991 | Corsmeier | |
| 5,076,050 | A | 12/1991 | Schwarz et al. | |
| 5,092,737 | A | 3/1992 | Lau | |
| 5,154,578 | A * | 10/1992 | Miraucourt et al. | 415/173.3 |
| 5,219,268 | A * | 6/1993 | Johnson | 415/115 |
| 5,399,066 | A | 3/1995 | Ritchie et al. | |
| 5,403,158 | A | 4/1995 | Auxier | |
| 5,593,277 | A * | 1/1997 | Proctor et al. | 415/173.1 |
| 5,601,402 | A | 2/1997 | Wakeman et al. | |
| 5,779,442 | A * | 7/1998 | Sexton et al. | 415/173.2 |
| 6,082,963 | A | 7/2000 | Sexton et al. | |
| 6,116,852 | A | 9/2000 | Pierre et al. | |
| 6,126,390 | A | 10/2000 | Bock | |
| 6,368,054 | B1 | 4/2002 | Lucas | |
| 6,435,823 | B1 | 8/2002 | Schroder | |
| 6,702,550 | B2 * | 3/2004 | Darkins et al. | 415/139 |
| 6,726,446 | B2 * | 4/2004 | Arilla et al. | 415/138 |
| 6,863,495 | B2 | 3/2005 | Halliwell et al. | |
| 6,935,836 | B2 | 8/2005 | Ress, Jr. et al. | |
| 7,079,957 | B2 | 7/2006 | Finnigan | |
| 7,125,223 | B2 | 10/2006 | Turnquist et al. | |
| 7,287,955 | B2 | 10/2007 | Amiot et al. | |
| 7,333,913 | B2 | 2/2008 | Andarawis | |
| 7,597,537 | B2 | 10/2009 | Bucaro et al. | |
| 7,652,489 | B2 | 1/2010 | Dasgupta | |
| 7,722,310 | B2 | 5/2010 | Balasubramaniam | |
| 8,121,813 | B2 | 2/2012 | Ren | |
| 8,177,476 | B2 | 5/2012 | Andrew | |
| 8,186,945 | B2 | 5/2012 | Bhatnagar | |

* cited by examiner

*Primary Examiner* — Igor Kershteyn
(74) *Attorney, Agent, or Firm* — Fletcher Yoder, P.C.

(57) ABSTRACT

A system includes a turbine casing including a first hook configured to mate with a second hook to support a turbine shroud about a plurality of turbine blades. The turbine casing includes a coolant circuit configured to adjust clearance between the turbine shroud and the turbine blades based on coolant flow through the coolant circuit. The coolant circuit includes a first plurality of radial coolant passages extending into the first hook.

26 Claims, 6 Drawing Sheets

SYSTEM AND METHOD FOR CLEARANCE CONTROL IN A ROTARY MACHINE

BACKGROUND OF THE INVENTION

The subject matter disclosed herein relates to clearance control techniques, and more particularly to a system for adjusting the clearance between a stationary component and a rotary component of a rotary machine.

In certain applications, a clearance may exist between components that move relative to one another. For example, a clearance may exist between rotary and stationary components in a rotary machine, such as a compressor, a turbine, or the like. The clearance may increase or decrease during operation of the rotary machine due to temperature changes or other factors. As can be appreciated, a smaller clearance may improve performance and efficiency in a compressor or turbine, because less fluid leaks between blades and a surrounding shroud. However, a smaller clearance also increases the potential for a rub condition. The operating conditions also impact the potential for a rub condition. For example, the potential for a rub condition may increase during transient conditions and decrease during steady state conditions. Unfortunately, existing systems do not adequately control clearance in rotary machines.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In one embodiment, a system includes a turbine cooling assembly. The turbine cooling assembly includes a first coolant insert configured to mount in a first recess within a turbine section. The first coolant insert includes a first plurality of radial coolant passages. The turbine cooling assembly further includes a second coolant insert configured to mount in a second recess axially offset from the first recess within the turbine section. The second coolant insert includes a second plurality of radial coolant passages. Additionally, the turbine cooling assembly includes a coupling piece configured to mount to the turbine section between the first and second coolant inserts, wherein the coupling piece includes at least one axial coolant passage coupled to the first plurality of radial coolant passages and the second plurality of radial coolant passages.

In another embodiment, a system includes a turbine coolant insert configured to mount into a recess in a turbine casing that supports a shroud about a plurality of turbine blades, wherein the turbine coolant insert includes a plurality of radial coolant passages configured to extend radially into a shroud hook of the turbine casing. The turbine coolant insert is further configured to adjust clearance between the shroud and the turbine blades based on coolant flow through the turbine coolant insert.

In yet another embodiment, a system includes a turbine casing including a first hook configured to mate with a second hook to support a turbine shroud about a plurality of turbine blades. The turbine casing includes a coolant circuit configured to adjust clearance between the turbine shroud and the turbine blades based on coolant flow through the coolant circuit. The coolant circuit includes a first plurality of radial coolant passages extending into the first hook.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
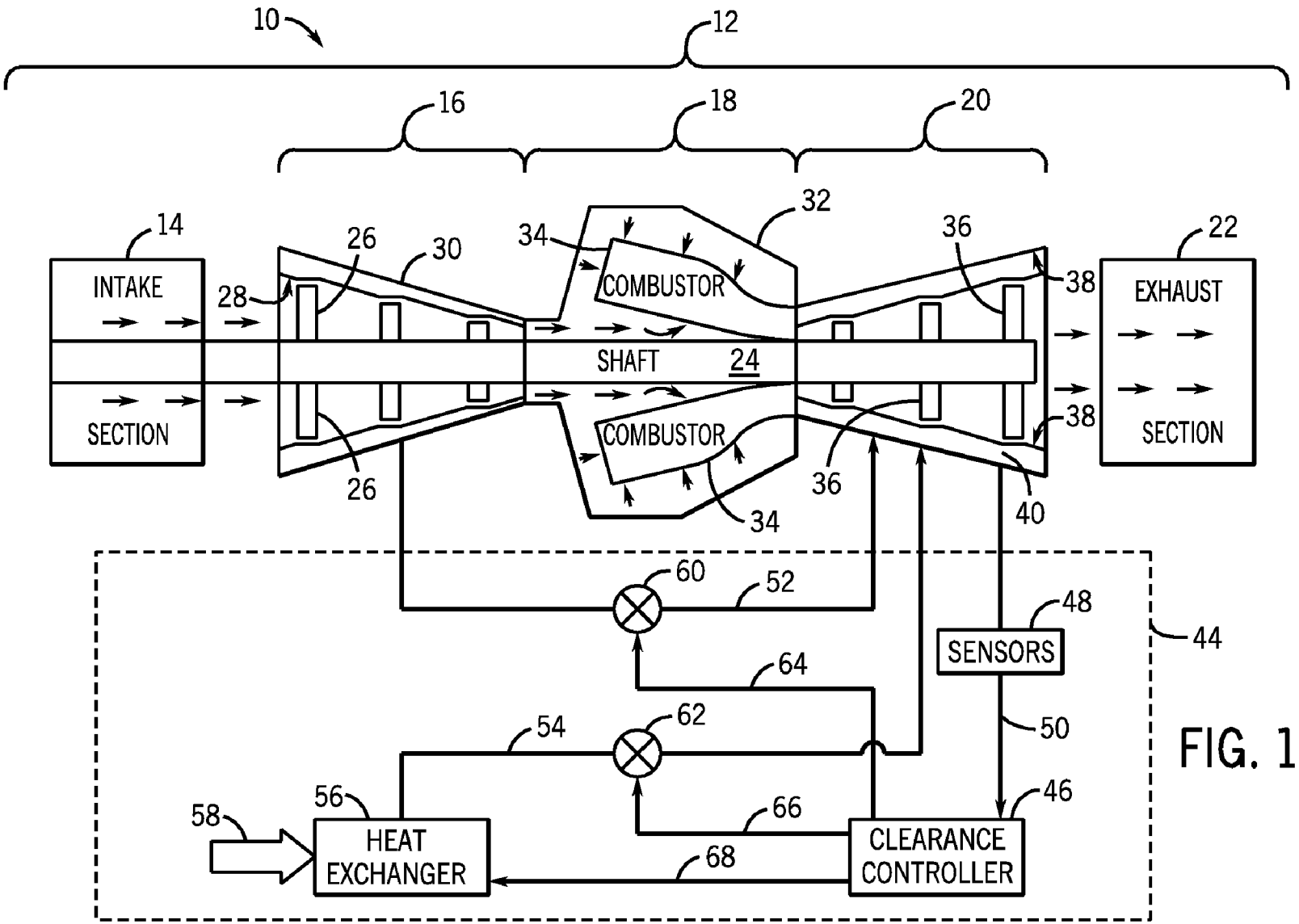
FIG. 1 is a diagram illustrating a system that includes a gas turbine engine having clearance control features, in accordance with an embodiment of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements.

The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

As discussed in detail below, the present disclosure generally relates to clearance control techniques using forced convective cooling. Such techniques may be implemented in a system, such as a turbine engine-based system (e.g., aircraft, locomotive, power generator, etc.). As used herein, the term "clearance" or the like shall be understood to refer to a spacing or gap that may exist between two or more components of the system that move relative to one another during operation. The clearance may correspond to an annular gap, a linear gap, a rectangular gap, or any other geometry depending on the system, type of movement, and other various factors, as will be appreciated by those skilled in the art. In one application, the clearance may refer to the radial gap or space between housing components surrounding one or more rotating blades of a compressor, a turbine, or the like. By controlling the clearance using the presently disclosed techniques, the amount of leakage between the rotating blades and the housing may be actively reduced to increase operational efficiency, while simultaneously minimizing the possibility of a rub (e.g., contact between housing components and the rotating blades). As will be appreciated, the leakage may correspond to any fluid, such as air, steam, combustion gases, and so forth.

In accordance with embodiments of the invention, a turbine engine utilizing the clearance control features disclosed herein may include a turbine casing having a plurality of radial and axial coolant passages. For instance, in one embodiment of a turbine application having one or more stages, the turbine casing may, for each stage, include a first and second hook configured to respectively couple to corresponding third and fourth hooks on a shroud piece positioned circumferentially about a rotational axis of the turbine and enclosing one or more turbine blades. An annular groove may extend radially into each of the first and second hooks on the turbine casing. A coolant insert element having radial grooves on both sides may be inserted or recessed into each of the annular grooves. The radial grooves on each side of the coolant insert may be fluidly coupled, thus defining a plurality of generally U-shaped passages within each annular groove. A coupling piece having a plurality of axial grooves may be disposed on the turbine casing between the annular grooves, thus defining a plurality of axial passages. In some embodiments, the coupling piece may be generally ring-shaped (e.g., annular). The axial passages may fluidly couple the U-shaped passages within the first hook to the U-shaped passages within the second hook.

As discussed above, a radial gap between the turbine blades and a shroud may increase or decrease during operation due to temperature changes or other factors. For instance, as the turbine heats up during operation, thermal expansion of the turbine housing components may cause the shroud to move radially away from the rotational axis, thus increasing the clearance between the blades and the shroud. This is generally undesirable because combustion gases that bypass the blades via the radial gap are not captured by the blades and are, therefore, not translated into rotational energy. This reduces the efficiency and power output of the turbine engine.

To control clearance, a coolant flow may be introduced into the U-shaped and axial passages discussed above. The coolant fluid may be relatively cooler than the combustion gases flowing through the turbine and, in some embodiments, may be air sourced from one or more stages of a compressor. In other embodiments, a separate air source and/or heat exchanger may be utilized to provide a coolant flow. In further embodiments, a liquid coolant may also be used. In operation, the coolant is introduced into a first set of U-shaped passages in the first hook. The coolant flows through the first set of U-shaped passages, i.e., radially towards and then away from the rotational axis, into corresponding axial passages defined by the coupling piece, and then into a second set of U-shaped passages in the second hook. The coolant may exit the second set of U-shaped passage into an annular passage defined by an outer surface of the turbine casing and a coolant sleeve disposed circumferentially thereabout. The coolant may flow downstream (e.g., relative to the flow of combustion gases) along the annular passage, and may exit the annular passage via one or more inlets on the turbine casing that fluidly couple the annular passage to a cavity on the inner surface of the turbine casing. As used herein, the term downstream shall be understood to refer to the axial direction of flow of coolant flow through the coolant passages (e.g., in the same direction of flow of combustion gases through the turbine), and the term upstream shall be understood to mean the axial direction opposite the flow of the coolant in the downstream direction.

As will be discussed in further detail below, the flow of a coolant through the coolant passages (e.g., the U-shaped and axial passages) may cool the turbine casing via forced convective cooling, which may counteract and/or reduce thermal expansion of the shroud. That is, the turbine casing may be configured to contract or expand a certain amount based on the temperature and/or flow rate of coolant in the coolant passage. A controller may be utilized with the turbine system to actively control the coolant flow and/or temperature. In this manner, a desired clearance with respect to rotating turbine blades and the shroud may be actively maintained. In some embodiments, the coolant passages may be differently configured at various circumferential locations of the turbine casing. For instance, regions of the turbine casing that are more sensitive to thermal effects may be configured to receive more coolant flow (e.g., greater concentration of coolant passages). Thus, a desired clearance may be maintained even if the turbine casing itself is out-of-round, or becomes out-of-round during operation (e.g., due to deformation caused by uneven thermal expansion, etc.). It should be noted that each of the coolant inserts and the coupling piece may be individually fabricated. Thus, manufacturing of the turbine casing having the above-mentioned coolant passages may be simplified by providing the coolant inserts and the coupling piece as separate discrete components that may be easily assembled to the turbine casing in a modular manner (e.g., as opposed to machining the turbine casing from a single piece of material).

Further, in addition to coolants, a heating fluid may also be supplied into the coolant passages to speed up or increase thermal expansion under certain conditions. For instance, during transient conditions, it may be preferable to provide a larger radial gap to mitigate the possibility of a rub, at least until operation reaches steady-state. Thus, while the U-shaped and axial passages are referred to herein as "coolant passages," it should be understood that a heating fluid may also be supplied thereto to expand the clearance under certain conditions. Accordingly, the controller may further sense operating conditions measured by sensors, such as temperature sensors, vibration sensors, position sensors, etc. Depending upon the sensed conditions, the clearance may be reduced (e.g., by flowing a coolant through the coolant passages) or increased (e.g., by flowing a heating fluid through the coolant passages) to substantially optimize turbine performance. These aspects, advantages, and various other features will be discussed below with reference to FIGS. 1-9.

With the foregoing in mind, FIG. 1 is a block diagram of an exemplary system 10 that includes a gas turbine engine 12 having radial and axial coolant passages for clearance control, in accordance with embodiments of the present technique. In certain embodiments, the system 10 may include an aircraft, a watercraft, a locomotive vehicle, a power generation system, or some combination thereof. Accordingly, the turbine engine 12 may drive a variety of loads, such as a generator, a propeller, a transmission, a drive system, or a combination thereof. The turbine system 10 may use liquid or gas fuel, such as natural gas and/or a hydrogen rich synthetic gas, to run the turbine system 10. The turbine engine 12 includes an air intake section 14, a compressor 16, a combustor section 18, a turbine 20, and an exhaust section 22. As shown in FIG. 1, the turbine 20 may be drivingly coupled to the compressor 16 via a shaft 24.

In operation, air enters the turbine system 10 through the air intake section 14 (indicated by the arrows) and may be pressurized in the compressor 16. The compressor 16 may include compressor blades 26 coupled to the shaft 24. The compressor blades 26 may span the radial gap between the shaft 24 and an inner wall or surface 28 of a compressor housing 30 in which the compressor blades 26 are disposed. By way of example, the inner wall 28 may be generally annular or conical in shape. The rotation of the shaft 24 causes rotation of the compressor blades 26, thereby drawing air into the compressor 16 and compressing the air prior to entry into the combustor section 18. The combustor section 18 includes a combustor housing 32 disposed concentrically or annularly about the shaft 24 and axially between the compressor 16 and the turbine 20. Within combustor housing 32, the combustor section 20 may include a plurality of combustors 34 disposed at multiple circumferential positions in a generally circular or annular configuration about the shaft 24. As compressed air exits the compressor 16 and enters each of the combustors 34, the compressed air may be mixed with fuel for combustion within each respective combustor 34. For example, each combustor 34 may include one or more fuel nozzles that may inject a fuel-air mixture into the combustor 34 in a suitable ratio for optimal combustion, emissions, fuel consumption, and power output. The combustion of the air and fuel may generate hot pressurized exhaust gases, which may then be utilized to drive one or more turbine blades 36 within the turbine 20.

The turbine 20 may include the above-mentioned turbine blades 36, and an outer turbine casing 40. As will be shown in further detail below, the outer casing 40 may include a shroud 38 that is disposed about the turbine blades 36, as well as an inner turbine casing coupled to the shroud and disposed concentrically within an outer turbine casing. The turbine blades 36 may be coupled to the shaft 24 and span the radial gap between the shaft 24 and the shroud 38, which may be generally annular or conical in shape. A small radial gap generally separates the turbine blades 36 from the shroud 38 to reduce the possibility of contact between the turbine blades 36 and the shroud 38. As will be understood, contact between the turbine blade 36 and the shroud 38 may result in an undesirable condition generally referred to as "rubbing" and may cause excessive wear or damage to one or more components of the turbine engine 12.

The turbine 20 may include a rotor element that couples each of the turbine blades 36 to the shaft 24. Additionally, the turbine 20 depicted in the present embodiment includes three stages, each stage being represented by a respective one of the illustrated turbine blades 36. Nozzles may be disposed between each stage to guide the flow of combustion gases through the turbine 20. It should be appreciated, that other configurations may include more or fewer turbine stages. In operation, the combustion gases flowing into and through the turbine 20 flow against and between the turbine blades 36, thereby driving the turbine blades 36 and, thus, the shaft 24 into rotation to drive a load. The rotation of the shaft 24 also causes the blades 26 within the compressor 16 to draw in and pressurize the air received by the intake 14. Further, in some embodiments, the exhaust exiting the exhaust section 22 may be used as a source of thrust for a vehicle such as a jet plane, for example.

As further shown in FIG. 1, the turbine system 10 may include a clearance control system 44. The clearance control system 44 may include a clearance controller 46, as well as one or more sensors 48, which may be disposed at various locations of the turbine system 10. The clearance controller 46 may include various hardware and/or software components programmed to execute routines and algorithms for adjusting the clearance (e.g., a radial gap) between the turbine blades 36 and the shroud 38. The sensors 48 may be used to communicate various data 50 about the operating conditions of the turbine engine 12 to the clearance controller 46 so that the clearance controller 46 may actively adjust clearance accordingly. For example, the sensors 48 may include temperature sensors for sensing a temperature, vibration sensors for sensing vibration, flow sensors for sensing a flow rate, positional sensors, or any other sensors suitable for detecting various operating conditions of the turbine 12, such as a rotational speed of the shaft 24, power output, etc. Though shown as being coupled to the turbine 20, it should be understood that the sensors 48 may be positioned at/in any component of the turbine system 10, including the intake 14, compressor 16, combustor 18, turbine 20, and/or exhaust section 22, etc.

Coolant flow may be supplied to the coolant passages of the turbine 20 via the flow lines 52 and 54. As shown, flow line 52 may be configured to provide a flow of air siphoned from the compressor 16. As will be appreciated, in each consecutive stage of the compressor 16, the air received via intake 14 is subject to increased pressurization, and thus increases in temperature. By way of example only, the temperature of pressurized air at the eighth stage of a sixteen-stage compressor may be between approximately 400 to 600 degrees Fahrenheit, and the temperature of pressurized air in the twelfth stage may be between approximately 700 to 1000 degrees Fahrenheit. As the compressor air is fed into the combustor 34 and reacts with fuel to achieve the combustion process, the temperature of resulting combustion gases within the combustor 34 may reach temperatures of between approximately 2000 to 3500 degrees Fahrenheit or more. As the combustion gases exit the combustor 34 and enters the turbine section 20 (e.g., as exhaust gases), the temperature of the combustion gases may have cooled, for example, to between approximately 900 to 1300 degrees Fahrenheit. Thus, it should be noticed that the compressor air is still generally cooler relative to the temperature of the combustion gases flowing into the turbine section 20. Accordingly, in certain embodiments, the controller 46, depending on the amount of cooling needed to maintain a target clearance under a particular set of operating conditions, may be configured to select an air source for the flow line 52 from any of the compressor stages, or could use air from a single compressor stage and vary the flow rate.

The flow line 54 is coupled to a heat exchanger 56, which is coupled to an external fluid source 58. The heat exchanger 56 may be integrated into the system 10, or may be provide on a separate external skid. The heat exchanger 56, in response to control signals 68 from controller 46, may cool or heat the external fluid source 58 to a desired temperature based, for example, on sensed data 50. Thus, the depending on the cooling needed to maintain a particular target clearance, the controller 46 may select either the flow line 52 or 54 to provide a coolant flow to the coolant passages in the turbine 20. As shown, each of the flow lines 52 and 54 may include valves 60 and 62, respectively. The controller 46 may actively manipulate the valves 60 and 62 by way of control signals 64 and 66, respectively, in order to actively control a flow rate of coolant through the flow lines 52 and 54. By way of example, the valves 60 and 62 may be configured to provide for a range of flow rates between approximately 0 to 15 pounds per second. In one embodiment, the flow rates may be at least less than approximately 3, 4, 5, 6, 7, 8, 9, or 10 pounds per second. In another embodiment, the valves 60 and 62 may be on-off valves, and the controller may toggle the valves 60 or 62 between an open and closed state to provide or not provide a coolant flow. Additionally, as mentioned above, a heating fluid may also be routed to the coolant passages in the turbine 20 to increase clearance, such as during transient turbine operating conditions.

Figure 2:
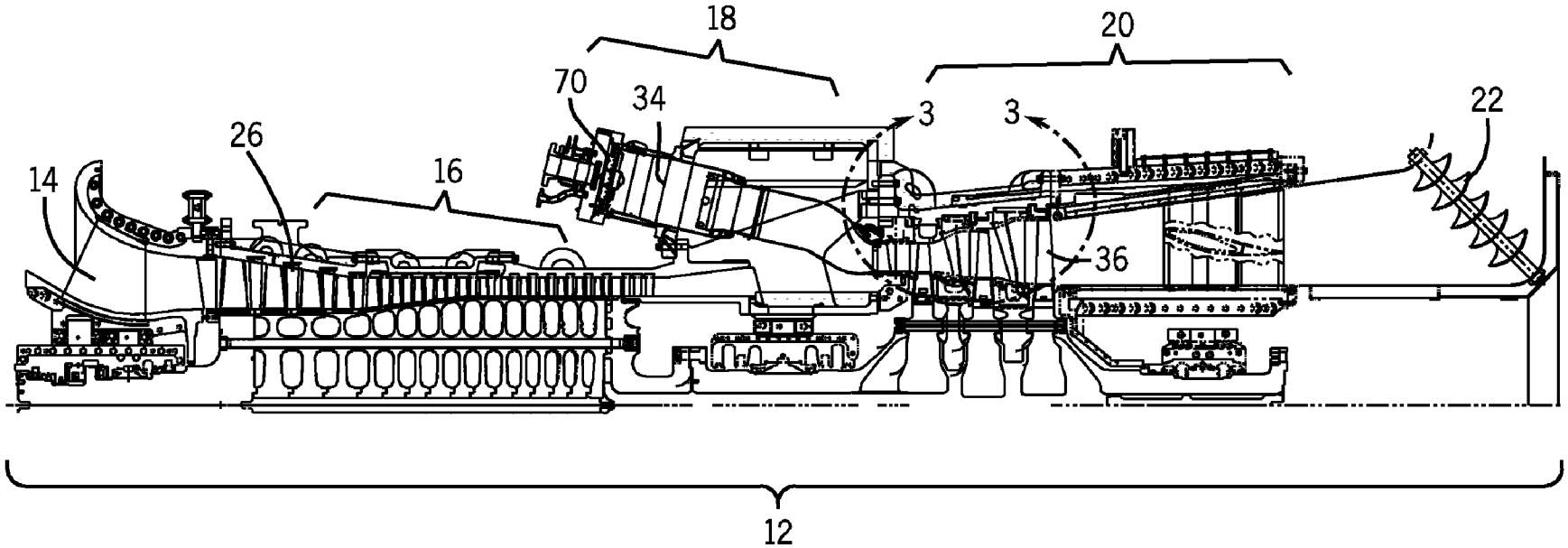
FIG. 2 is a cutaway side view of the turbine system shown in FIG. 1, in accordance with an embodiment of the present technique.

Referring to FIG. 2, a cutaway side view of an embodiment of the turbine engine 12 schematically depicted in FIG. 1 is illustrated. The turbine engine 12 includes one or more fuel nozzles 70 located inside one or more combustors 34. In operation, air enters the turbine engine 12 through the air intake 14 and is pressurized in the compressor 16. The compressed air may then be mixed with gas for combustion within combustor 34. For example, the fuel nozzles 70 may inject a fuel-air mixture into the combustor 34 in a suitable ratio for optimal combustion, emissions, fuel consumption, and power output. The combustion generates hot pressurized exhaust gases, which then drive one or more blades 36 within the turbine 20 to rotate the shaft 24. The rotation of shaft 24 causes the compressor blades 26 within the compressor 16 to draw in and pressurize the air received by the intake 14.

As will be discussed in further detail below the turbine 20 may include an inner turbine casing coupled to the shroud 38. A plurality of radial and axial coolant passages may receive the coolant flow provided by flow lines 52 and/or 54, as discussed above. As the coolant flow through the coolant passages, heat is transferred away from the turbine casing by forced convective cooling principles and, thus, the thermal expansion of the turbine casing and/or the shroud may be reduced, thus decreasing a radial gap between the turbine blades 36 and the shroud 38. In one embodiment, the coolant may be a portion of compressor air supplied via flow line 52, and may between approximately 0.1 to 10 percent of the total air flowing in the compressor 16. For instance, the portion of compressor air supplied via flow line 52 may be at least less than approximately 0.1, 0.5, 1, 2, 3, 4, 5, 6, 7, 8, 9, or 10 percent of the total compressor air.

Figure 3:
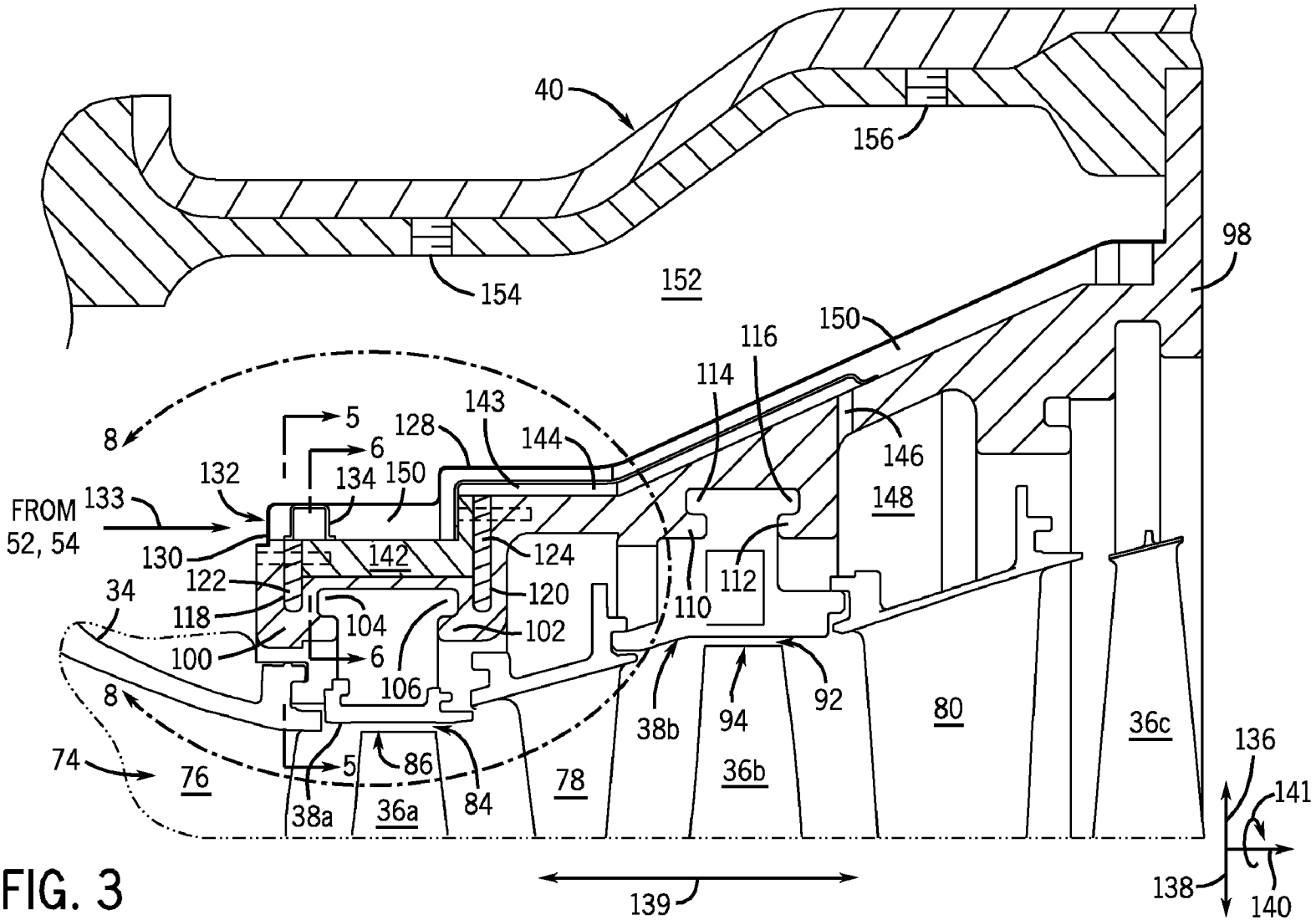
FIG. 3 is a partial axial cross-section of the turbine of FIG. 1 taken generally within arcuate line 3-3 of FIG. 2 and illustrating an embodiment of a turbine casing having coolant passages for clearance control.

The active clearance control features described herein may be better understood with reference to FIG. 3, which shows a partial axial cross-section of the turbine section 20 of FIGS. 1 and 2 taken within arcuate line 3-3 of FIG. 2. The illustrated embodiment is a three-stage turbine, as indicated by the first-stage turbine blades 36*a*, second-stage turbine blades 36*b*, and third-stage turbine blades 36*c*. Other embodiments may include fewer or more turbine stages. As combustion gases 74 exit the downstream end of the combustor 34, the combustion gases 74 flow through first-stage nozzles 76 configured to direct the combustion gases 74 towards the first-stage blades 36*a*. The combustion gases 74 then flow through second-stage nozzles 78 towards the second-stage blades 36*b*. Finally, the combustion gases 74 flow through third-stage nozzles 80 and towards third-stage blades 36*c*.

As shown, the tip 86 of turbine blade 36*a* may be separated from the inner shroud section 38*a* by a radial gap 84. Similarly, the tip 94 of turbine blade 36*b* may be separated from the inner shroud section 38*b* by a radial gap 92. As discussed above, the radial gaps 84 and 92 reduce the possibility of contact between the turbine blades 36*a* and 36*b* and the inner shroud sections 38*a* and 38*b*, and also provide a path for combustion gases 74 to bypass the turbine blades 36 as the combustion gases 74 flow downstream along the downstream axial direction 140, as indicated by the reference axes. As can be appreciated, gas bypass is generally undesirable because energy from the bypassing gas is not captured by the turbine blades 36 and translated into rotational energy, thus reducing the efficiency and power output of the turbine engine 12. That is, turbine system efficiency is at least partially dependent on the quantity of combustions gases captured by the turbine blades 36. Thus, by reducing the radial gaps 84 and/or 92, the power output from the turbine 20 may be increased. However, as mentioned above, if the radial gap 84 and/or 92 is too small, rubbing may occur between the turbine blades 36 and the shroud 38, resulting in possible wear and damage to components of the turbine engine 12.

The disclosed embodiments supply a coolant to a plurality of fluidly coupled radial and axial coolant passages in an inner turbine casing 98 to provide a suitable balance between increasing the efficiency of the turbine 20 and decreasing the possibility of contact or rubbing between the turbine blades 36 and the inner shroud (e.g., 38*a*, 38*b*). The inner turbine casing 98 may include a plurality of hooks configured to couple to respective corresponding hooks on the shroud segments. For instance, with reference to the first stage of the turbine 20, the inner turbine casing 98 includes hooks 100 and 102 which couple to corresponding hooks 104 and 106, respectively, of the inner shroud section 38*a*. In the second stage, the turbine casing 98 includes hooks 110 and 112 which couple to respective hooks 114 and 116 of inner shroud section 38*b*. During operation of the turbine engine 12, the heat from combustion gases 74 may cause the inner turbine casing 98 and the shroud 38 to thermally expand, i.e., move outwards in the radial direction 136 at a greater rate than the turbine blades 36. As thermal expansion occurs, the radial gaps 84 and 92 may increase. As discussed above, an increase in the clearance results in more gas bypassing the turbine blades 36, thus reducing turbine output and efficiency. In some embodiments, the inner shroud sections 38*a* and 38*b* may include positional sensors which may feed back data to the controller 46 for use in determining the appropriate control actions to maintain a particular clearance.

To control clearance, a plurality of fluidly coupled radial and axial coolant passages may be provided in the inner turbine casing 98. For instance, referring to the first stage of the turbine 20, annular grooves 118 and 120 extend radially into the hooks 100 and 102, respectively. Coolant inserts may be recessed or inserted into each of the annular grooves 118 and 120. For instance, a coolant insert 122 may be recessed into the annular groove 118, and a coolant insert 124 may be recessed into the annular groove 120. Though not shown in the present cross-sectional view, each of the coolant inserts 122 and 124 may include a plurality of radial grooves on an upstream side, each of which corresponds to a respective radial groove on a downstream side of the insert. When recessed into their respective grooves 118 and 120, the radial grooves on coolant inserts 122 and 124 may form a plurality of U-shaped coolant passages, each with a radial coolant passage on the upstream side of a coolant insert being fluidly coupled to a corresponding radial coolant passage on the downstream side of the coolant insert. In other words, the coolant inserts 122 and 124, when recessed into annular grooves 118 and 120, may form a plurality of U-shaped coolant passages circumferentially spaced in each annular groove 118 and 120. As will be discussed below, the U-shaped passages within the annular grooves 118 and 120 may be fluidly coupled by a plurality of axial coolant passages to provide for a flow of cooling fluid through each of the hooks 100 and 102 (e.g., in the directions 136 and 138).

A generally annular outer turbine shroud 128 may be concentrically coupled about the inner turbine casing 98. The upstream end 132 of the outer shroud 128 may include a plurality of inlets 130, which may be circumferentially arranged on the outer shroud 128 and configured to receive a flow of coolant from the flow lines 52 and/or 54, as indicated by the arrow 133. A sealing member 134 is disposed between the inner turbine casing 98 and the outer shroud 128 and may be configured to direct the coolant flow 133 into the radial passages on the upstream side of the first coolant insert 122. In another embodiment, the sealing member 134 may include another opening(s) and may straddle the entrance of the radial passages on insert 122, such that the coolant flows through the opening(s) on the sealing member and into the radial passages of insert 122. Accordingly, the coolant may flow along the radial passages on the upstream side of the coolant insert 122 in the radial direction 138 (e.g., towards the rotational axis 139 of shaft 24), and then along the downstream side of the coolant insert 122 in the opposite radial direction 136 (e.g., away from the rotational axis 139 of shaft 24), such that the flow path is generally U-shaped. The coolant may then continue to flow along one or more generally axial passages defined, for example, by grooves on a coupling piece 142. The axial passages fluidly couple the U-shaped passages in the groove 118 to similarly configured U-shaped passages in the groove 120. Thus, the coolant flows in an axial direction 140 along the axial passages of the coupling piece 142 and into radial passages on the upstream side of the second coolant insert 124 (e.g., in groove 120). The coolant then flows in the radial direction 138 along radial passage on the upstream side of coolant insert 124, and then in the radial direction 136 along corresponding radial passages on the downstream side of the insert 124.

As the coolant flow exits the downstream-side radial passages of the insert 124, the coolant flows into an annular passage 143 defined between the outer surface of the inner turbine casing 98 and a coolant seal 144. The coolant then continues to flow downstream (direction 140) generally along the outer surface of the inner turbine casing 98 and towards a plurality of inlets 146, which may be circumferentially arranged on the turbine casing 98. The coolant flow exits the annular passage 143 and into the cavity 148. From here, the exiting coolant flow may be dispersed and/or may be further routed downstream towards the exhaust section 22. While the passage 146 is shown as dumping the coolant into the cavity 148 in the present embodiment, the passage 146 could be located at different positions along the inner turbine casing 98 in other embodiments, such as in the region between hooks 110 and 112, for instance. The configuration of the U-shaped and axial passages discussed herein will be illustrated and discussed in further detail below.

A region 150 may be formed by the outer shroud 128 and the inner turbine casing 98, and may serve as a boundary between the coolant flow (e.g., through the U-shaped and axial passages) and a flow of air through a cavity 152 between the outer turbine casing 40 and the outer shroud 128. The cavity may receive an air flow via the inlets 154 and 156. Due to pressure differentials that may exist between the air in cavity 152 and the coolant flowing through the inner turbine casing 98, the region 150 may provide insulation. In some embodiments, the region 150 may be filled with an insulating material.

As will be appreciated, as coolant flows through the U-shaped passages and into the hooks 100 and 102, heat transfer may occur by way of forced convective cooling. Thus, as the inner turbine casing 98 is increasingly cooled, thermal expansion may be reduced, thus causing the inner turbine casing 98 and, particularly the hooks 100 and 102, to contract in the radial direction 138 to decrease the radial gap 84. By way of example only, the range of expansion/contraction of the inner turbine casing 98 using the clearance control techniques disclosed herein may be expressed as a function of the diameter of the inner turbine casing 98 (e.g., measured at the end coupled to a nozzle of combustor 34). For instance, the range of expansion/contraction may be approximately 1 to 3 radial-mils per inch of diameter. Thus, to provide one example, assuming a inner casing 98 diameter of 100 inches and an expansion amount of 1.25 radial-mils per inch of diameter, the expansion/contraction range of the inner turbine casing 98 may be approximately 125 radial-mils (0.125 radial-inches) with respect to the rotational axis 139. Similarly, if the expansion amount is 2 radial-mils per inch of diameter, then the expansion/contraction range of the inner turbine casing 98 may be approximately 200 radial-mils (0.2 radial-inches) with respect to the rotational axis 139. Again, it should be understood that the specific relationships provided herein are by way of example only. Indeed, depending on the particular implementation, operating temperatures, materials, and/or coolant used, different rates of expansion/contraction may be achieved.

Further, it should be noted that a similar arrangement of coolant passages may be implemented in hooks 110 and 112 to improve the clearance control of radial gap 92. Indeed, depending on the configuration of the turbine engine 12, the arrangement of coolant passages discussed herein may be implemented in one or more turbine stages. For simplicity, the coolant passages are only shown and described in the first stage of the turbine 20 in FIG. 3.

Figure 4:
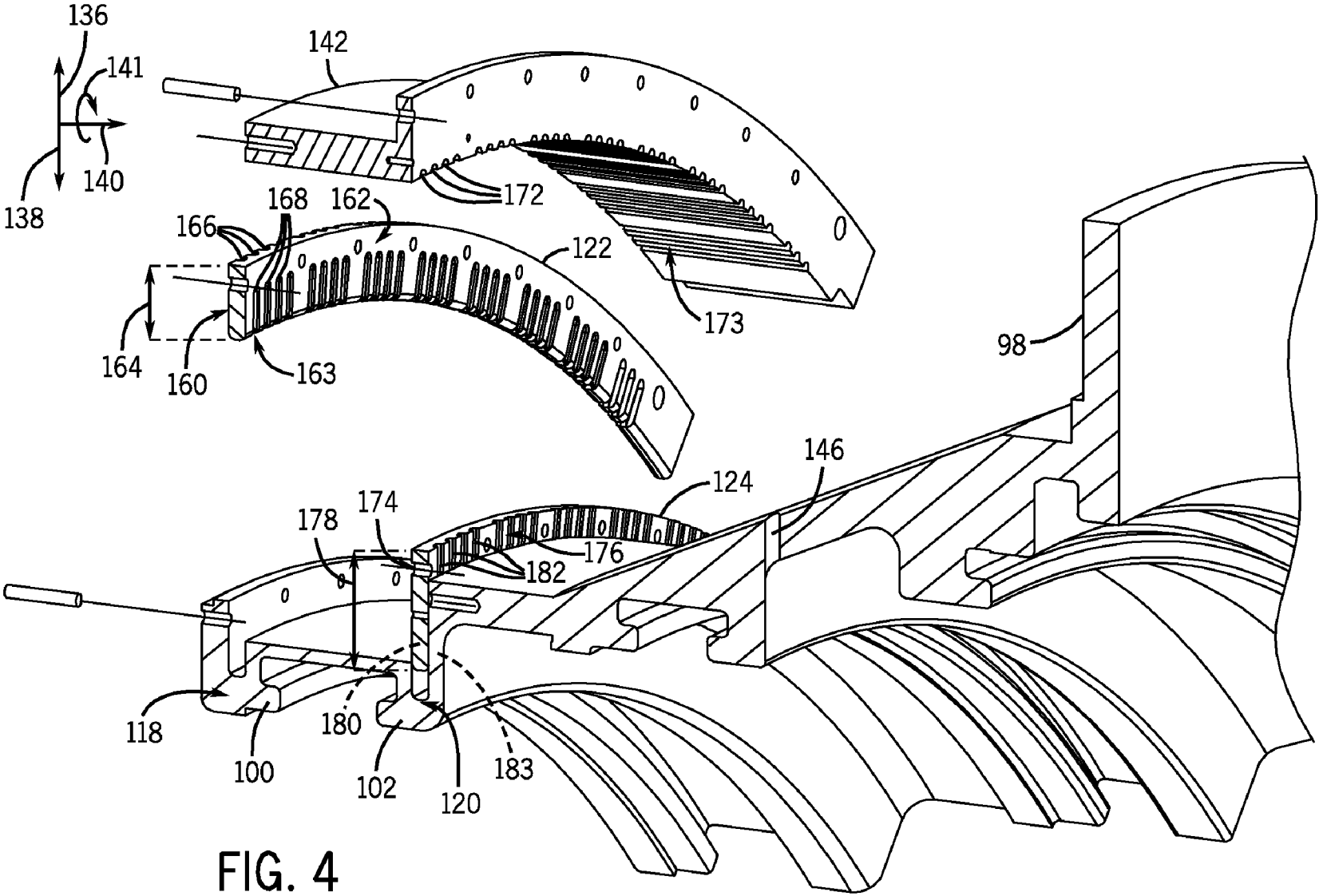
FIG. 4 is a perspective partially-exploded view of the turbine casing of FIG. 3 showing the assembly of coolant inserts and a coupling piece that defines a plurality of radial and axial coolant passages, in accordance with an embodiment of the present technique.

Referring now to FIG. 4, a perspective and partially-exploded view of the inner turbine casing 98, the coolant inserts 122 and 124, and the coupling piece 142, is illustrated in accordance with one embodiment. The first insert 122, which is shown as being fully exploded from the annular groove 118 and having a radial height 164, includes radial grooves 166 on an upstream side 160, and radial grooves 168 on a downstream side 162. The radial grooves 166 and 168 are fluidly coupled by an axial space 163 at the base of the insert 122, thus defining generally U-shaped grooves which, when recessed into the annular groove 118, define a first plurality of U-shaped passages. Further, in the present embodiment, the radial grooves 166 may extend along the entire radial height 164 of the insert 122, but the radial grooves 168 may extend only along a portion of the radial height 164, such that the coolant is directed into corresponding axial grooves 172 on the bottom side 173 of the coupling piece 142, which forms axial passages when the coupling piece 142 is assembled onto the inner turbine casing 98.

The second insert 124 is shown as being partially exploded from the annular groove 120 and having a radial height 178. Depending on the configuration of the inner turbine casing 98 and the inserts 122 and 124, the radial heights may 164 and 178 may be the same or may differ. The insert 124 includes radial grooves 180, referred to by the phantom lead line, on an upstream side 174 and includes radial grooves 182 on a downstream side 176. The radial grooves 180 and 182 are fluidly coupled by an axial space 183 at the base of the insert 124, thus defining generally U-shaped grooves which, when recessed into the annular groove 120, define a second plurality of U-shaped passages. Further, as shown, the radial grooves 180 may extend along only a portion of the height 178 so as to direct the coolant flow exiting the axial passages 172 in the radial direction 138. The radial grooves 182 may extend along the entire radial height 178 of the insert 124 to provide an exit for the coolant flow into annular passage 143 (FIG. 3).

In accordance with embodiments of the present invention, the cooling inserts 122 and 124 generally span the circumference of the annular grooves 118 and 120, but may be formed from multiple segments (e.g., 2 to 100 segments). For instance, the cooling insert 122 may include four arcuate segments, each spanning 90 degrees of the circumference of the annular groove 118. In one embodiment, each of the segments may be independently controlled by controller 46. For instance, separate independent coolant flows may be provided along flow lines 52 or 54 and directed into the U-shaped passages of each respective individual insert segment. Additionally, depending on the thermal characteristics of the inner turbine casing 98 where a particular insert segment is located, the configuration of the radial grooves on each insert segment may vary. For instance, an insert in a particularly thermally sensitive section of the inner turbine casing 98 may be configured to receive more coolant than other segments, and/or may include more and/or deeper radial grooves 166 and 168. Additionally, the grooves 166 and 168 may have different spacing arrangements. In another embodiment, the radial grooves 166 and 168 may be generally uniform for each segment of the insert 122, and the controller 46 may direct independent flows of coolant of varying temperatures and/or flow rates, depending on the thermal characteristics of each insert segment. For instance, if a particular section of the turbine casing 98 expands more rapidly, the controller 46 may supply a coolant flow from a cooler compressor stage or, alternatively, increase the flow rate of the coolant. Similarly, if a particular section of the turbine casing expands more slowly, the controller 46 may supply a coolant flow from a warmer or hotter compressor stage or, alternatively, provide a slower flow rate of the coolant. In other embodiments, the turbine casing 98 itself and/or the coupling piece 142 may include multiple sections coupled by through bolts or any other suitable type of fastening member.

As will be appreciated, the independent control of coolant flow to multiple sections of the insert (which may be segmented), may be particularly useful in addressing out-of-round issues. For instance, turbine casing 98 may become deformed during operation due to the fact that, in some embodiments, the turbine casing 98 may be split at a plane passing through the shaft 24 centerline (e.g., the rotational axis 139) to enable better access to the internal components of the turbine 20, for example, during service and maintenance. In such a configuration, a horizontal joint may be used to mate the two pieces of the inner turbine casing structure 98. By way of example, the joint may include two mating flanges with through-bolts that provide clamping pressure between the flanges, thus coupling the pieces of the turbine casing 98 together. However, the additional radial thickness due to the presence of the flanges may result in a thermal response in the general proximity of the flanges that differs from the rest of the turbine casing 98, as well as a discontinuity in circumferential stresses that may develop during operation of the turbine 20. The combined effect of the thermal response and stress discontinuity at the flange joints may cause the turbine casing 98 to become out-of-round during the operation of the turbine 20. Thus, by providing independently controllable coolant flows to multiple sections of the inner turbine casing 98, thermal expansion may be controlled to compensate for non-circularity of the turbine casing 98 due to out-of-roundness, thus maintaining a suitable clearance about the entire circumference of the turbine 20 despite possible non-circularity of the turbine casing 98 and shroud 38.

Before continuing, it should be noted that each of the coolant inserts 122 and 124 and the coupling piece 142 may be individually fabricated or manufactured (e.g., by machining). Thus, the manufacturing costs of the inner turbine casing 98 may be simplified by providing the coolant inserts 122 and 124 and the coupling piece 142 as separate discrete components that may be assembled to the turbine casing 98 in a modular manner using any suitable type of fastening techniques, such as bolts, screws, welds, and so forth. In other embodiments, the coupling piece 142 could also be a single solid piece (e.g., not modular). Additionally, in another embodiment, the coupling piece 142 could be provided as an annular member without grooves 172, such that an annular passage is formed then the coupling piece 142 is secured to the inserts 122 and 124. In such embodiments, the coolant flow exiting the inserts 122 enters the annular passage (rather separate, respective axial grooves), and flows into the radial passages on inserts 124. By way of example only, in such embodiments, the coupling piece 142 could be an annular piece of sheet metal adapted to fit around the inner turbine casing 98 in a concentric manner to define the annular passage that couples the radial passages on the inserts 122 and 124. Further, while the grooves 172 are depicted in the illustrated embodiment as being generally straight in the axial direction 139 and parallel with one another, it should be understood that the grooves 172 may have other configurations in different embodiments. For example, the grooves 172 may also define passages that are curved and/or v-shaped (e.g., not parallel with one another), or passages that have an axial component in combination with radial and/or circumferential components (relative to the rotational axis 139).

Figure 5:
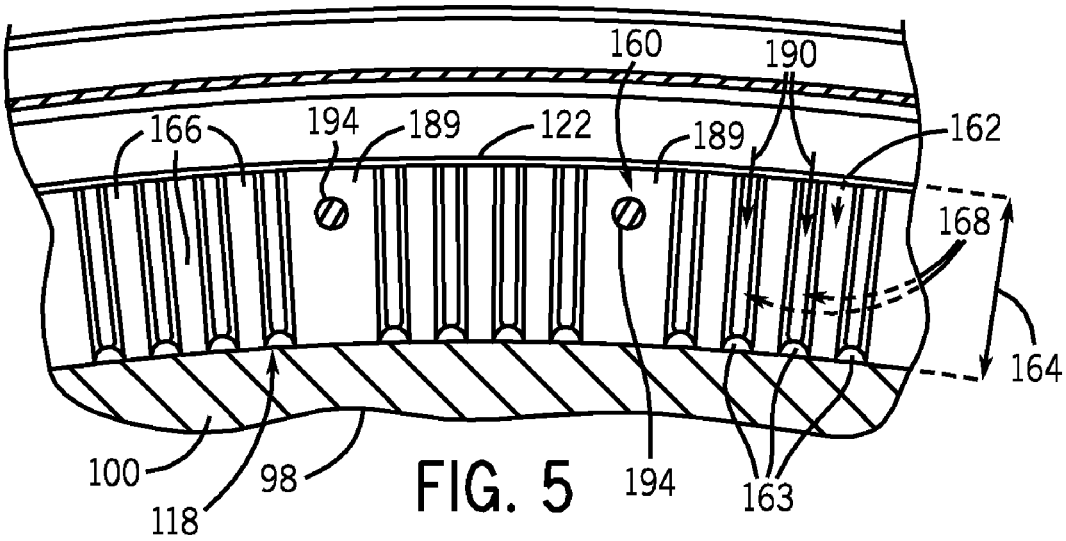
FIG. 5 is a partial radial cross-section of the turbine casing of FIG. 3 taken along cut-line 5-5 and showing a portion a coolant insert having a plurality of radial coolant passages, in accordance with an embodiment of the present technique.

Continuing now to FIG. 5, a partial radial cross-section showing a portion of the inner turbine casing 98 and coolant insert 122 taken along cut-line 5-5 of FIG. 3 is illustrated. As shown, the coolant insert 122 is recessed into the annular groove 118. The upstream side 160 of the insert 122 includes the above-discussed plurality of radial grooves 166, which form radial passages when recessed into annular groove 118. For the purposes of this description, coolant passages formed via the corresponding grooves on the inserts 122 or 124 or the coupling piece 142 shall be referred to with like reference numerals.

In the present embodiment, the radial passages 166 are arranged in groups of four, although any other suitable arrangement may be implemented. Between each grouping of the radial passages 166, the insert 122 may include a non-grooved portion 189 having an opening 194. The openings 194 may be configured to receive a bolt or screw, or some other suitable type of fastening device, for securing the insert 122 to the inner turbine casing 98 during assembly. As discussed above, a coolant flow is directed into each of the radial passages 166 on the upstream side 160 of insert 122, as indicated by flow arrows 190. The coolant flows radially towards the rotational axis 139 (FIG. 3) of shaft 24 and through the axial spacings 163 into corresponding radial passages 168 on the downstream side 162 (shown by the phantom arrows and lead lines). As discussed above, the radial passages 168 may only extend along a portion of the radial height 164, so as to direct the coolant flow into corresponding downstream axial passages 172 formed on the coupling piece 142.

Figure 6:
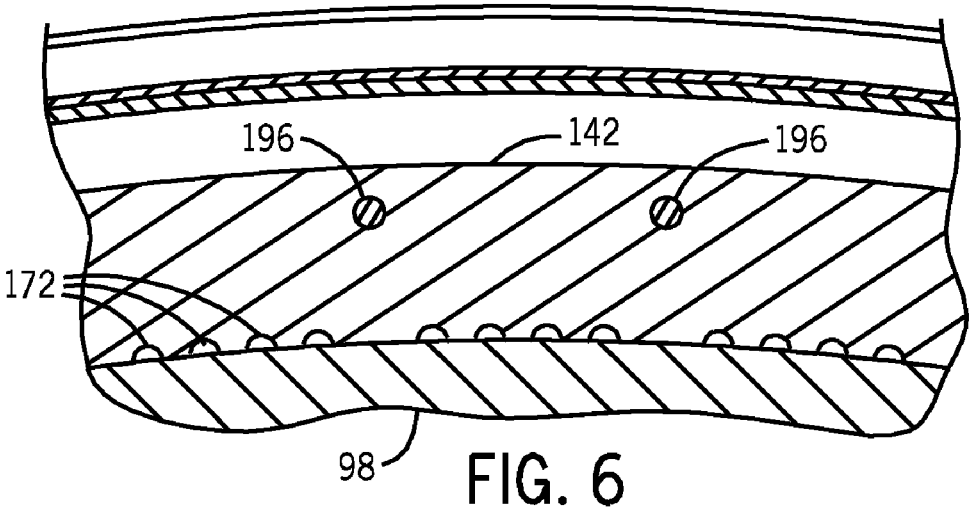
FIG. 6 is a partial radial cross-section of the turbine casing of FIG. 3 taken along cut-line 6-6 and showing a portion of a coupling piece having a plurality of axial coolant passages, in accordance with an embodiment of the present technique.
Figure 7:
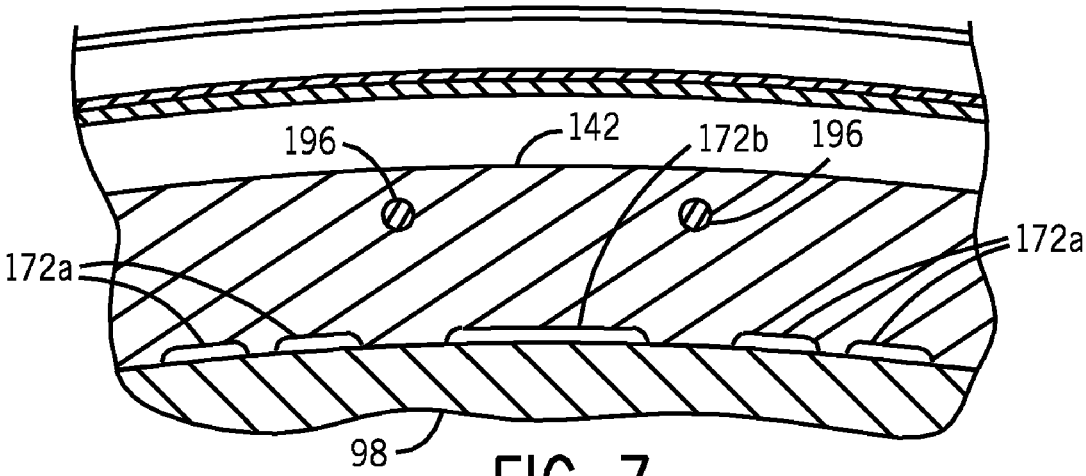
FIG. 7 is a partial radial cross-section taken along cut-line 6-6 of FIG. 3 and showing a portion of a coupling piece having a plurality of axial coolant passages, in accordance with another embodiment of the present technique.

Referring now to FIG. 6, a partial radial cross-section showing a portion of the inner turbine casing 98 and the coupling piece 142 taken along cut-line 6-6 of FIG. 3 is illustrated. As shown, the coupling piece 142 is assembled onto the inner turbine casing 98 to define the axial passages 172. The coupling piece 142 may include openings 196, which may align with the openings 194 on the insert 122. Thus, fastening members (e.g., bolts or screws) used to secure the insert 122 to inner turbine casing 98 may extend through the openings 196 to additionally secure the coupling piece 142 to the insert 122 and the inner turbine casing 98. In the depicted embodiment, the axial passages 172 are generally arranged in groups of four to correspond with each group of radial U-shaped passages shown in FIG. 5 in a one-to-one manner. That is, each radial passage 168 (on downstream side 162 of insert 122) may be fluidly coupled to a respective one of the illustrated axial passages 172.

In some embodiments, the axial passages 172 may not correspond to the radial passages 168 in a one-to-one manner. For instance, referring to FIG. 7, a partial radial cross-section showing another embodiment of a portion of the inner turbine casing 98 and the coupling piece 142 taken along cut-line 6-6 of FIG. 3 is illustrated. Here, the axial passages 172 may correspond to two or more of the radial passages 168. For instance, as shown, the axial passages 172*a* may be fluidly coupled to two radial passages 168, and the axial passages 172*b* may be fluidly coupled to an entire grouping of four radial passages 168. As discussed above, coolant exiting the radial passages 168 may flow in the axial direction (direction 140 in FIG. 3) downstream to a second plurality of U-shaped passages on insert 124 within the annular groove 120. The coolant may exit radial passages 182 on the downstream side of the insert 124 into an annular passage 143 formed by a coolant seal 144 and the inner turbine casing 98.

Figure 8:
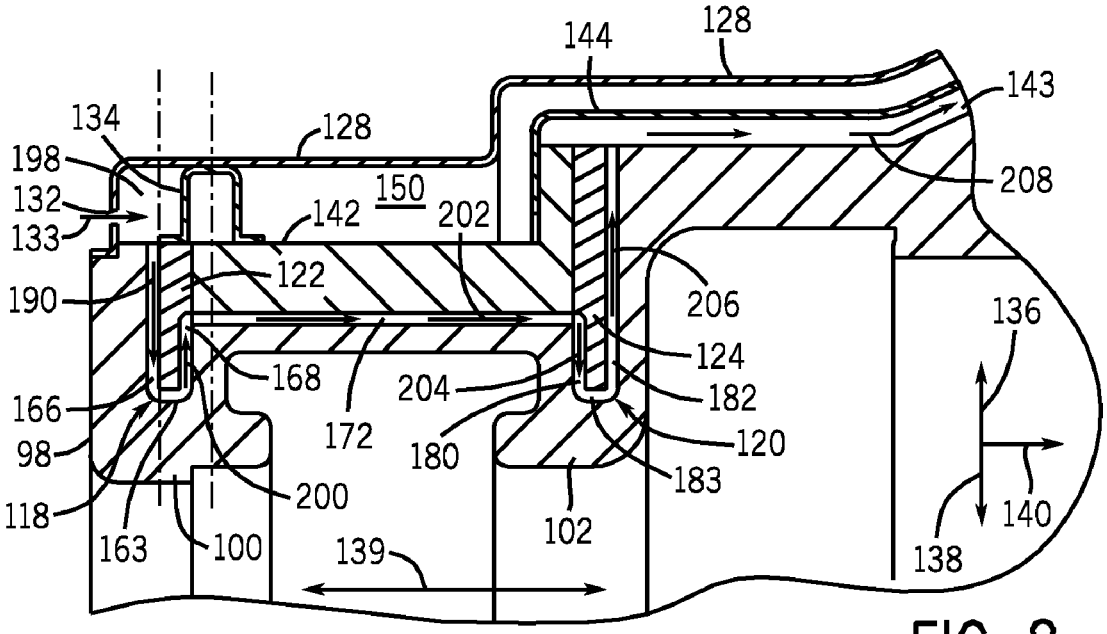
FIG. 8 is a more detailed partial axial cross-section of the turbine casing taken within arcuate line 8-8 of FIG. 3 and along cut-line 8-8 of FIG. 5 and showing a coolant flow through the radial and axial passages, in accordance with an embodiment of the present technique.

The flow path of coolant through the U-shaped and axial passages may be better understood when described with reference to FIG. 8, which is a more detailed partial axial cross-section of the inner turbine casing 98 taken within the arcuate line 8-8 of FIG. 3 and along cut-line 8-8 of FIG. 5. As shown in FIG. 8, a flow of coolant 133, which may be provided by coolant flow lines 52 or 54 (via the controller 46), enters inlets 130, which may be arranged circumferentially along the upstream end 132 of the outer shroud 128. The coolant flow 133 enters the cavity 198, and is directed into the radial passage 166 (arrow 190) in the direction 138. As discussed above, the radial passage 166 is defined by radial grooves on the upstream side of the insert 122 when inserted into the annular groove 118. The coolant continues to flow in the direction 138 until it reaches the axial space 163. Here, the coolant flow reverses (arrow 200) and flows in the direction 136 along the radial passage 168. From the radial passage 168, the coolant enters an axial passage 172, which may be formed by the assembly of the coupling piece 142 to the inner turbine casing 98.

The coolant proceeds to flow along the axial passage 172 (arrow 202) and enters a radial passage 180 on the upstream side of the insert 124. The coolant is directed through the radial passage (arrow 204) in the direction 138 until it reaches the axial space 183. The coolant then flows in direction 136 through the radial passage 182 (arrow 206), and eventually exits the radial passage 182 and enters the annular passage 143 which, as discussed above, is defined by the outer surface of the inner turbine casing 98 and the coolant seal 144. The coolant then continues to flow downstream (direction 140) and eventually exits the annular passage 142 by way of one or more inlets 146 (FIG. 3). As discussed above, a region 150 may be defined between the inner turbine casing 98 and the outer shroud 128.

As discussed above, the flow of the coolant through the U-shaped passages facilitates heat transfer by way of forced convective cooling. By providing for the radial passages into the hooks 100 and 102, the present technique offers improved heat transfer in those regions and, more effective clearance control. Particularly, the inserts 122 and 124 having U-shaped radial passages provide for cooling deeper (e.g., in radial direction 138) into the hooks 100 and 102, thus providing a greater percentage of cooling in the radial direction and, consequently, a greater range of clearance control. In essence, the greater volume of cooling allows the coolant to provide more expansion and contraction in the inner turbine casing 98. As will be appreciated, the degree of expansion and contraction provided may be some what proportional to the depth at which the U-shaped radial passages extend radially into hooks 100 and 102. Particularly, deeper cooling (e.g., into hooks 100 and 102) allows more efficient use of the coolant to provide improved contraction/expansion in the inner casing piece 98. Cooling deeper into the hooks may provide a thermal barrier, which may translate into a lower average temperature of the inner turbine casing 98. Additionally, the axial passages 172 formed via the coupling piece 142 may provide a thermal barrier, such that a generally constant temperature exists across the space between the inserts 122 and 124 and above the axial passages 172 (e.g., in the radial direction 136).

As discussed above, data 50 received from sensors 48 may be utilized by the clearance controller 46 to vary a flow rate and/or temperature of coolant provided to one or more sections of the turbine 20. If the controller 46 determines that clearance is to be decreased, a flow of coolant through the radial passages 166, 168, axial passage 172, and radial passages 180 and 182 may remove heat, and thus reduce thermal expansion of the inner turbine casing 98 during turbine operation. As the inner turbine casing 98 contracts, the hooks 100 and 102 may contract radially towards (direction 138) the rotational axis 139 of the shaft 24, thus also causing a shroud (e.g., inner shroud section 38*a*) to move radially towards (direction 138) rotational axis 139. Accordingly, a radial gap (e.g., 84) between the shroud 38 and the turbine blades 36 is reduced, thereby increasing turbine output and efficiency.

Additionally, in some embodiments, a heating fluid may also be introduced into the radial passages 166, 168, axial passage 172, and radial passages 180 and 182, to increase or speed up thermal expansion, such as during transient conditions. For example, during start-up, it may be preferable to provide a greater degree of clearance in order to mitigate the possibility of a rub, at least until operation reaches steady-state conditions.

Figure 9:
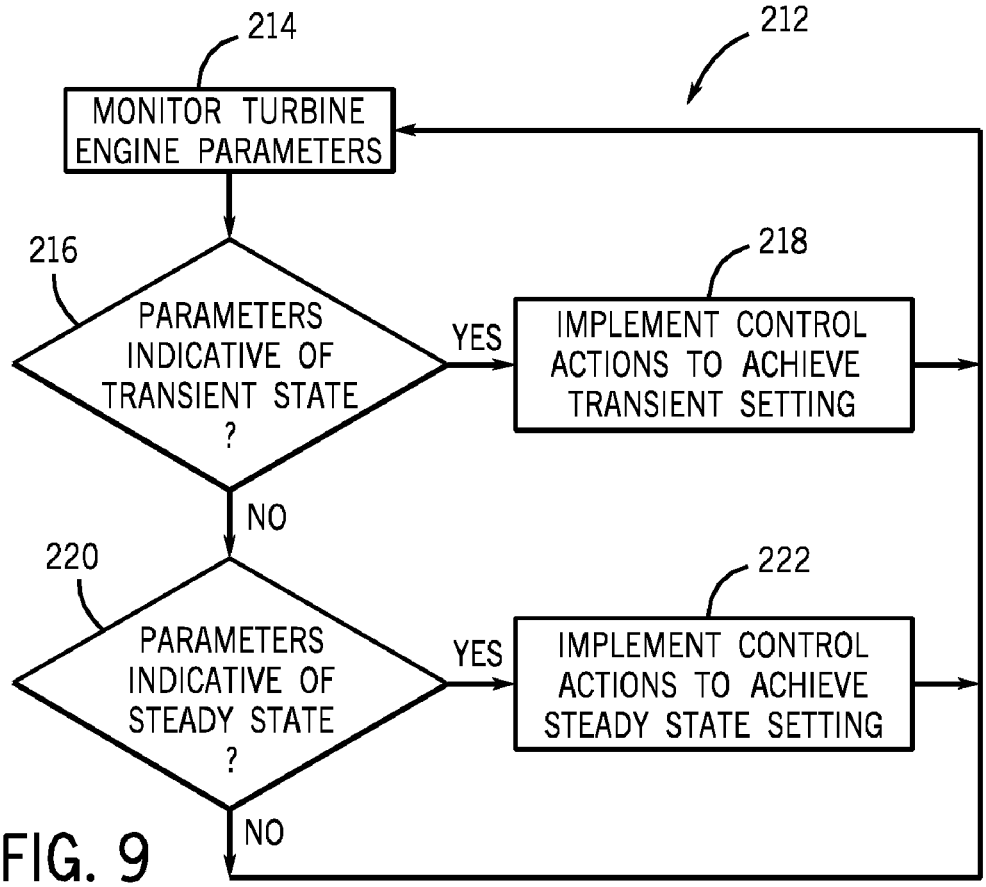
FIG. 9 is a flow chart depicting a method for controlling clearance based upon an operating condition of a turbine system, in accordance with an embodiment of the present technique.

Referring now to FIG. 9, a computer-implemented method 212 for actively adjusting clearance based on measured parameters of the turbine engine 12 is shown. The method 212 may begin by monitoring one or more parameters of the turbine engine 12, as indicated at block 214. The parameters may be measured by the turbine sensors 48 discussed above and may be related to any suitable parameter of the turbine engine 12 that may be used to determine an appropriate clearance. For example, some parameters may relate to the temperature within the turbine 20 or of certain components of the turbine 20 (e.g., blades 36, inner turbine casing 98, etc.), vibration levels in the turbine 20, the rotational speed of the shaft 24, the power output of the turbine 12, a flow rate of combustion gases, pressure data, or some combination thereof. Additionally, some parameters may relate to a control input of the turbine engine 12. For example, some parameters may relate to a specified power level or operating state of the turbine engine 12, an elapsed time period since start-up of the turbine engine 12, or a start-up and/or shut-down input.

Parameter(s) of the turbine engine 12 monitored at block 214 may then be used to determine a desired clearance setting at decision blocks 216 and 218. For instance, based upon the sensed parameters from block 214, the controller 46 may determine, at block 216, whether the parameters indicate a transient state of the turbine engine 12, i.e. a state in which a changing parameter of the turbine engine 12 may have a tendency to cause rapid changes in the clearance. For example, one or more parameters may relate to a temperature of the outer casing 40, inner casing 98, the blades 36, or some other component of the turbine engine 12. If the temperature is detected as rapidly changing, this may indicate that the turbine engine 12 is in a transient state such as startup or shutdown.

If a transient state is detected, the method 212 proceeds to block 218, at which control actions are implemented to achieve a transient state setting. For example, in one embodiment, such control actions may cause thermal expansion of the inner turbine casing 98 to be increased or sped up by flowing a heating fluid through the coolant passages within the turbine hooks 100 and 102, with the goal of setting the clearance to a maximum level as quickly as possible to reduce possibility of contact between the shroud sections 38 and the turbine blades 36 during the transient state. Thereafter, the method 212 may return to block 214 and continue to monitor operating parameter(s) of the turbine engine 12. In one embodiment, the determination of whether the turbine engine 12 is operating in a transient state or a steady-state condition may also be based on empirical measurements or theoretical estimates regarding the amount of time that the turbine engine 12 takes to reach a steady state after start-up or after some other change in the power setting of the turbine engine 12. The empirical data may be used to program specified time-constants into the clearance controller 46 representing the amount of time taken to achieve steady-state conditions after certain changes in the power setting of the turbine engine 12 have been initiated. For instance, after a particular change in the power setting of the turbine engine 12 has taken place, the clearance controller 46 may keep track of the amount of time that has elapsed since the change in the power setting to determine whether the turbine engine 12 is in a transient state or a steady state. If the elapsed time is greater than the specified time-constant, this may indicate that the turbine engine 12 has reached steady-state operating condition. If, however, the elapsed time is less than the specified time-constant, this may indicate that the turbine engine 12 is still in a transient operating state.

Returning to decision block 216, if the monitored parameters are not indicative of a transient state, then the method 120 may continue to the steady-state decision block 220. If, for example, it is determined that the measured parameter (e.g., temperature) is relatively constant over a period of time, this may indicate that the turbine engine 12 has reached a steady-state operating condition. Thus, the method 212 continues to step 222, at which one or more control actions are implemented to achieve a steady state setting. For instance, such actions may be implemented by the controller 46 to reduce the clearance between the shroud 38 and the turbine blades 36. For example, the controller 46 may introduce a coolant flow, such as via flow lines 52 or 54 (by manipulating valves 60 and 62). As discussed above, the coolant may flow through the U-shaped passages (166 and 168, 180 and 182) and axial passages 172, thus cooling the hooks 100 and 102 via forced convective heat transfer and reducing or reversing thermal expansion of the turbine casing 98. As the inner turbine casing 98 contracts, the hooks 100 and 102 may contract radially towards (direction 138) the rotational axis of the shaft 24, thus also causing a shroud (e.g., inner shroud section 38*a*) to move radially towards (direction 138) rotational axis. Accordingly, a radial gap (e.g., 84) between the shroud 38 and the turbine blades 36 is reduced, thereby increasing turbine output and efficiency. Thereafter, the method 212 returns to block 214 from block 222 and continues monitoring operating parameter(s) of the turbine engine 12. Additionally, the method 212 may also return to block 214 from decision block 220 and continue monitoring turbine parameters if neither a transient or steady-state condition is detected at decision blocks 216 or 220.

While the description above has focused on an arrangement of coolant passages with regard to hooks 100 and 102, which correspond generally to the first stage of the turbine 20, it should be understood that the above-described techniques could be implemented in other stages of the turbine 20. For instance, a similar arrangement of coolant passages may be provided in hooks 110 and 112 of the second stage of the turbine 20 (FIG. 3). Indeed, in a multi-stage turbine 20, the coolant passages may be provided for one or more of the turbine stages. Further, it should be further appreciated that while the present examples have generally described the application of the clearance control techniques described herein with regard to a turbine of a turbine engine system, the foregoing techniques may also be applied to a compressor of the turbine engine system, as well as to any type of system that includes a stationary component and a rotary component and wherein a clearance is to be maintained between the stationary and rotary components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine cooling assembly, comprising:

a first coolant insert configured to mount in a first recess within a turbine section, and the first coolant insert comprises a first plurality of radial coolant passages;

a second coolant insert configured to mount in a second recess axially offset from the first recess within the turbine section, and the second coolant insert comprises a second plurality of radial coolant passages; and a coupling piece configured to mount to the turbine section between the first and second coolant inserts, wherein the coupling piece comprises at least one axial coolant passage coupled to the first plurality of radial coolant passages and the second plurality of radial coolant passages.

2. The system of claim 1, comprising a clearance controller configured to adjust a flow rate, a temperature, or a combination thereof, of a coolant flow through the first coolant insert, the coupling piece, and the second coolant insert to vary a clearance in the turbine section.

3. The system of claim 1, comprising:

a shaft comprising an axis of rotation;

a plurality of blades coupled to the shaft;

an inner shroud section disposed circumferentially about the blades, wherein the shroud comprises a first hook and a second hook;

an inner turbine casing disposed circumferentially about the shroud, wherein the inner turbine casing comprises a third hook coupled to the first hook and a fourth hook coupled to the second hook;

an outer shroud piece disposed circumferentially about the inner turbine casing; and wherein the first coolant insert is disposed between the inner turbine casing and the outer shroud piece, and wherein the first coolant insert is recessed into a first annular groove extending radially into the third hook;

wherein the second coolant insert is disposed between the inner turbine casing and the outer shroud piece, and wherein the second coolant insert is recessed into a second annular groove extending radially into the fourth hook; and wherein the coupling piece is coupled to both the first and second plurality of radial coolant passages at opposite axial end portions.

4. The system of claim 3, wherein the at least one axial coolant passage comprises a plurality of axial coolant passages coupled to the first and second plurality of radial coolant passages.

5. The system of claim 4, wherein the first and second plurality of radial coolant passages each comprise a plurality of U-shaped passages offset from one another in a circumferential direction relative to the axis of rotation.

6. The system of claim 3, wherein:

the first coolant insert comprises a first set of radial grooves, a second set of radial grooves, and a first divider disposed axially between the first and second sets of radial grooves, wherein the first annular groove at least substantially closes the first and second sets of radial grooves on opposite axial sides of the first coolant insert to define the first plurality of radial coolant passages; and the second coolant insert comprises a third set of radial grooves, a fourth set of radial grooves, and a second divider disposed axially between the third and fourth sets of radial grooves, wherein the second annular groove at least substantially closes the third and fourth sets of radial grooves on opposite axial sides of the second coolant insert to define the second plurality of radial coolant passages.

7. The system of claim 3, wherein the coupling piece comprises a set of axial grooves disposed against a surface of the inner turbine casing to define the at least one axial coolant passage.

8. The system of claim 3, comprising a coolant sleeve disposed about the inner turbine casing, wherein the coolant sleeve extends between a first turbine stage and a second turbine stage, and the first turbine stage comprises the first coolant insert, the second coolant insert, and the coupling piece.

9. The system of claim 8, comprising another set of coolant inserts and another coupling piece disposed at the second turbine stage.

10. A system, comprising:

a turbine coolant insert configured to mount into a recess in a turbine casing that supports a shroud about a plurality of turbine blades, wherein the turbine coolant insert comprises a plurality of radial coolant passages configured to extend radially into a first hook of the turbine casing radially along a radially overlapping interface with a second hook of the shroud, and the turbine coolant insert is configured to adjust clearance between the shroud and the turbine blades based on coolant flow through the turbine coolant insert.

11. The system of claim 10, comprising a plurality of turbine coolant insert segments disposed adjacently about a circumference of the turbine casing within the recess.

12. The system of claim 11, wherein at least two of the turbine coolant insert segment have a different configuration of the radial coolant passages.

13. The system of claim 12, wherein the different configuration comprises a different size, a different spacing, a different number, or a combination thereof, of the radial coolant passages.

14. The system of claim 11, comprising a clearance controller configured to independently control a flow rate, a temperature, or a combination thereof, of a coolant through the radial coolant passages of the plurality of turbine coolant insert segments.

15. The system of claim 10, wherein the turbine coolant insert comprises a first set of radial grooves, a second set of radial grooves, and a divider disposed axially between the first and second sets of radial grooves, wherein the first and second sets of radial grooves are configured to be at least substantially closed by the recess on opposite axial sides of the turbine coolant insert to define the plurality of radial coolant passages.

16. The system of claim 10, wherein the plurality of radial coolant passages comprises a plurality of U-shaped passages offset from one another in a circumferential direction relative to an axis of rotation of the turbine blades.

17. The system of claim 10, comprising a coupling piece disposed adjacent to the turbine coolant insert, wherein the coupling piece comprises a plurality of axial coolant passages coupled to the plurality of radial coolant passages.

18. A system, comprising:

a turbine casing comprising a first hook configured to mate with a second hook along a radially overlapping interface to support a turbine shroud about a plurality of turbine blades, wherein the turbine casing comprises a coolant circuit configured to adjust clearance between the turbine shroud and the turbine blades based on coolant flow through the coolant circuit, and the coolant circuit comprises a first plurality of radial coolant passages extending into the first hook radially along the radially overlapping interface.

19. The system of claim 18, wherein the coolant circuit comprises a plurality of axial coolant passages in parallel with one another and a rotational axis of the turbine blades, and the plurality of axial coolant passages is coupled to the plurality of radial coolant passages.

20. The system of claim 19, wherein the radial coolant passages are disposed in a plurality of arcuate insert segments configured to mount in an annular groove extending into the first hook, and the axial coolant passages are defined between an outer circumferential surface of the turbine casing and a coupling piece disposed about the outer circumferential surface.

21. A system, comprising:

a turbine coolant insert configured to mount into a recess in a turbine casing that supports a shroud about a plurality of turbine blades, wherein the turbine coolant insert comprises a plurality of radial coolant passages configured to mount adjacent a shroud hook of the turbine casing, and the turbine coolant insert is configured to adjust clearance between the shroud and the turbine blades based on coolant flow through the turbine coolant insert, wherein the turbine coolant insert comprises:

a first set of radial grooves;

a second set of radial grooves; and a divider disposed axially between the first and second sets of radial grooves, wherein the first and second sets of radial grooves are configured to be at least substantially closed by the recess on opposite axial sides of the turbine coolant insert to define the plurality of radial coolant passages.

22. The system of claim 21, comprising a turbine engine having the turbine casing, the shroud, the plurality of blades, and the turbine cooling insert.

23. A system, comprising:

a turbine coolant insert configured to mount into a recess in a turbine casing that supports a shroud about a plurality of turbine blades, wherein the turbine coolant insert comprises a plurality of radial coolant passages configured to mount adjacent a shroud hook of the turbine casing, the turbine coolant insert is configured to adjust clearance between the shroud and the turbine blades based on coolant flow through the turbine coolant insert, and the plurality of radial coolant passages comprises a plurality of U-shaped passages offset from one another in a circumferential direction relative to an axis of rotation of the turbine blades.

24. The system of claim 23, comprising a turbine engine having the turbine casing, the shroud, the plurality of blades, and the turbine cooling insert.

25. A system, comprising:

a turbine coolant insert configured to mount into a recess in a turbine casing that supports a shroud about a plurality of turbine blades, wherein the turbine coolant insert comprises a plurality of radial coolant passages configured to mount adjacent a shroud hook of the turbine casing, and the turbine coolant insert is configured to adjust clearance between the shroud and the turbine blades based on coolant flow through the turbine coolant insert; and a coupling piece configured to mount adjacent to the turbine coolant insert, wherein the coupling piece comprises a plurality of axial coolant passages coupled to the plurality of radial coolant passages.

26. The system of claim 25, comprising a turbine engine having the turbine casing, the shroud, the plurality of blades, the turbine cooling insert, and the coupling piece.

* * * * *